US007066775B1

(12) United States Patent
Seter

(10) Patent No.: US 7,066,775 B1
(45) Date of Patent: Jun. 27, 2006

(54) PROPELLER WASH STRAIGHTENING DEVICE

(76) Inventor: Miles A. Seter, 401 Sorrento Ct., Punta Gorda, FL (US) 33950

( * ) Notice: Subject to any disclaimer, the term of this patent is extended or adjusted under 35 U.S.C. 154(b) by 0 days.

(21) Appl. No.: 11/143,790

(22) Filed: Jun. 2, 2005

(51) Int. Cl.
*B63H 5/14* (2006.01)

(52) U.S. Cl. ..... 440/66; 114/166; 440/67

(58) Field of Classification Search ..... 114/166; 440/65, 67, 38, 72
See application file for complete search history.

(56) References Cited

U.S. PATENT DOCUMENTS

| | | | | |
|---|---|---|---|---|
| 2,803,211 A | | 8/1957 | Erlbacher | |
| 3,249,083 A | | 5/1966 | Irgens | |
| 3,358,635 A | * | 12/1967 | McRee | 440/87 |
| 3,528,382 A | | 9/1970 | Clark et al. | |
| 3,722,454 A | | 3/1973 | Silvester | |
| 3,934,538 A | | 1/1976 | Canazzi | |
| 4,046,097 A | | 9/1977 | Hornung | |
| 4,505,684 A | | 3/1985 | Holden et al. | |
| 4,637,801 A | | 1/1987 | Schultz | |
| 4,832,634 A | * | 5/1989 | Kearns | 440/67 |
| 5,651,707 A | | 7/1997 | Lemont | |
| 5,906,522 A | | 5/1999 | Hooper | |
| 6,152,793 A | * | 11/2000 | Gongwer | 440/67 |

FOREIGN PATENT DOCUMENTS

DE 4012334 A1 * 10/1991

OTHER PUBLICATIONS

Translation of DE 40 12 334 A1*

* cited by examiner

*Primary Examiner*—Sherman Basinger
(74) *Attorney, Agent, or Firm*—Charles J. Prescott

(57) ABSTRACT

A prop wash straightening apparatus for increasing the efficiency of propeller-driven watercraft. An elongated outer tubular member open at each end thereof is adapted for connection to the boat or vessel to position said outer member immediately downstream of the propeller and in substantially longitudinal fixed alignment with the direction of axial thrust produced by the propeller. A plurality of elongated hollow open-ended inner tubular members are positioned in closely packed fashion within, and generally coextensive with a substantial portion of the length of the outer tubular member. A proximal or forwardly end of the inner tubular members is positioned in close proximity to a trailing plane of the propeller. The outer tubular member extends from the proximal end of the inner tubular members to surround the blade tips of the propeller to direct substantially all prop wash from the propeller into the inner tubular members.

25 Claims, 6 Drawing Sheets

80
70
10
78
L
82
10
76
74
72

70
72
74
76

100
94c
12
94b
94a
90
98
M
96
92c
12
92b
92
94
92a 90
92c
94c 114c
14
110
114b
114a
118
116
N
14
120
112c
114
112b
112a
112

110
114c
112c

PROPELLER WASH STRAIGHTENING DEVICE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to propeller propulsion systems for watercraft and more particularly to thrust enhancing devices and apparatus for improving the efficiency of such propeller propulsion means.

2. Description of Related Art

The use of a multi-bladed propeller to propel a watercraft, boat or vessel through the water is ancient. Although other propulsion means have been developed in recent times, the twisted blade propeller remains the mainstay of water propulsion. Although propeller configuration and design have become extremely sophisticated through the use of computerized design techniques, nonetheless as a propeller rotates in water to produce a net axial flow of water which propels the watercraft in the opposite direction thereto, some of the water discharging as prop wash from the propeller does so from the tips at an acute angle of up to 90° to the axial flow or longitudinal axis of the propeller. This nonaxial water flow off the tips of the propeller leads to considerable loss in efficiency and thrust for which the propeller is capable of producing. Moreover, a spiral twist is introduced into the water flow by the propeller which also dissipates or reduces some of the axial thrust potential of the propeller.

A number of prior art devices have attempted to improve the efficiency of water flow produced by propulsion means including these conventional propellers as follows:

U.S. Pat. No. 2,803,211 to Erlbacher
U.S. Pat. No. 3,249,083 to Irgens
U.S. Pat. No. 3,528,382 to Clark
U.S. Pat. No. 3,722,454 to Silvester
U.S. Pat. No. 3,934,538 to Canazzi
U.S. Pat. No. 4,046,097 to Hornung
U.S. Pat. No. 4,505,684 to Holden, et al.
U.S. Pat. No. 4,637,801 to Schultz
U.S. Pat. No. 5,651,707 to Lemont
U.S. Pat. No. 5,906,522 to Hooper In particular, U.S. Pat. No. 3,528,382 invented by Clark, et al. discloses a propulsive system which will utilize a considerable amount of energy from the rotation of the screw race by restoring it as for and aft propulsive effort on the vessel. A propeller duct assembly for watercraft which enhances the thrust of the propeller is taught by Schultz in U.S. Pat. No. 4,637,801.

U.S. Pat. No. 5,906,522 invented by Hooper discloses a thrust enhancer for a marine propeller. Irgens, in U.S. Pat. No. 3,249,083 teaches marine propulsion units including reaction jet arrangements for developing thrust.

A driving mechanism for watercraft which utilizes the propeller wash to impart additional driving thrust to the vessel is taught by Masta in U.S. Pat. No. 2,884,890 and Lemont teaches a propulsive thrust ring system in U.S. Pat. No. 5,651,707.

U.S. Pat. No. 3,722,454 to Silvester discloses a thrust augmenter device and Holden, et al. discloses a thrust tube propulsion system in U.S. Pat. No. 4,505,684.

The present invention provides an economical easily attachable addition to virtually any watercraft which is propeller driven. The apparatus forces virtually all of the water discharging from the propeller into an axial flow which discharges there from to produce propulsion for the watercraft in a substantially rearwardly axial flow without substantial amounts of radial or spiral twist prop wash energy loss.

BRIEF SUMMARY OF THE INVENTION

This invention is directed to a prop wash straightening apparatus for increasing the efficiency of propeller-driven watercraft. An elongated outer tubular member open at each end thereof is adapted for connection to the boat or vessel to position said outer member immediately downstream of the propeller and in substantially longitudinal fixed alignment with the direction of axial thrust produced by the propeller. A plurality of elongated hollow open-ended inner tubular members are positioned in closely packed fashion within, and generally coextensive with a substantial portion of the length of the outer tubular member. A proximal or forwardly end of the inner tubular members is positioned in close proximity to a trailing plane of the propeller. The outer tubular member extends from the proximal end of the inner tubular members to surround the blade tips of the propeller to direct substantially all prop wash from the propeller into the inner tubular members.

It is therefore an object of this invention to provide a means for increasing the propulsion efficiency of a propeller-driven watercraft.

Still another object of this invention is to provide an apparatus for improving the efficiency with which a propeller moves a watercraft in water and which is easily attachable to any propeller-driven watercraft.

Yet another object of this invention is to provide an elongated tubular apparatus with inner elongated tubes nested together to force water flow emanating from a propeller in water to transition from a spiral twist into a virtually completely axial flow extending longitudinally rearwardly from the propeller for enhanced efficiency thereof.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
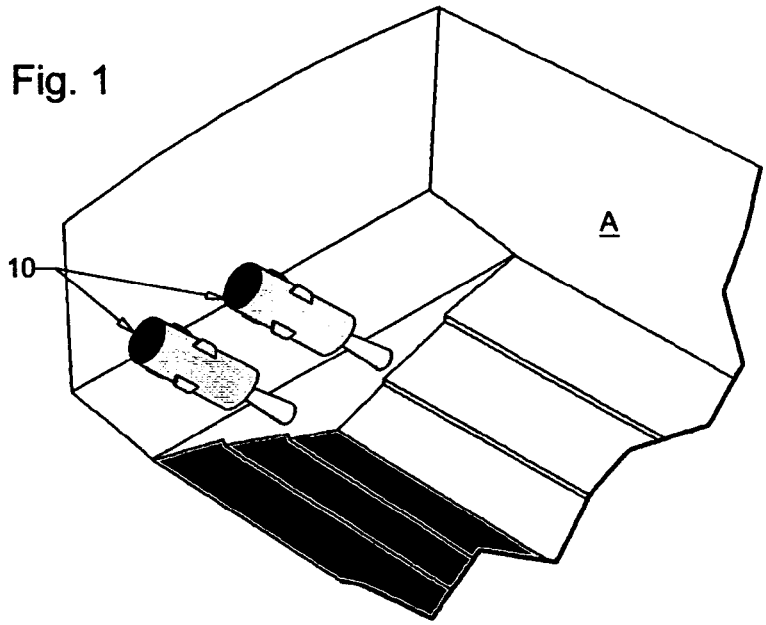
FIG. 1 is a rear perspective view of one embodiment of the invention attached to a twin propeller-driven watercraft.
Figure 2:
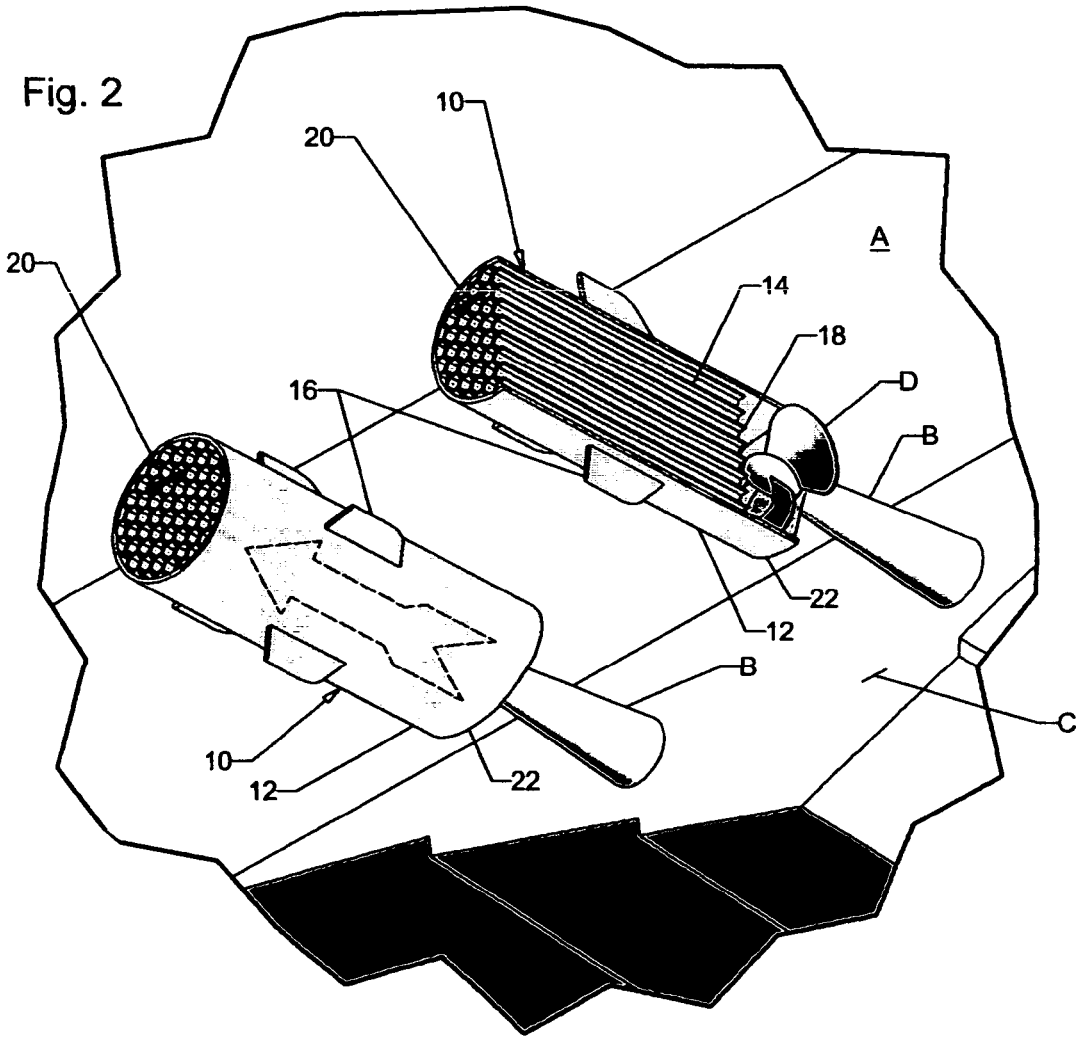
FIG. 2 is an enlarged broken view of FIG. 1.

Referring now to the drawings, and firstly to FIGS. 1 and 2, one embodiment of the invention is there shown generally at numeral 10 connected to the lower transom area of a watercraft A and in the immediate vicinity of and rearwardly extending from each propeller D supported on drive housings B. The apparatus 10 includes a substantially straight open ended outer tubular member 12 having a preferably circular cross section sized only slightly larger than the diameter of the propeller D. Thus tubular member extends from a position surrounding the tips of the propeller and rearwardly thereof.

A plurality of inner tubular members 20 are positioned and secured within the outer tubular member 12 and are nested in a most compact or nested orientation which is achievable with respect to circular cross section geometry. The leading surface of this plurality of inner tubular members at 18 is positioned in close proximity to the trailing plane or edge of the propeller D while the rearward planar surface of the inner tubular array at 20 is coplanar with the rearward open end of the outer tubular member 12.

As the propeller D rotates to propel the watercraft A, prop wash is forced fully into the plurality of tubular members 14 in the direction of the arrow shown in hidden lines so that virtually all of the water in the prop wash is resolved into a rearward axial flow within the plurality of inner tubes 14 absent a spiral twist or a radial component to increase propeller efficiency and increase the thrust produced for propelling the watercraft A.

Figure 3:
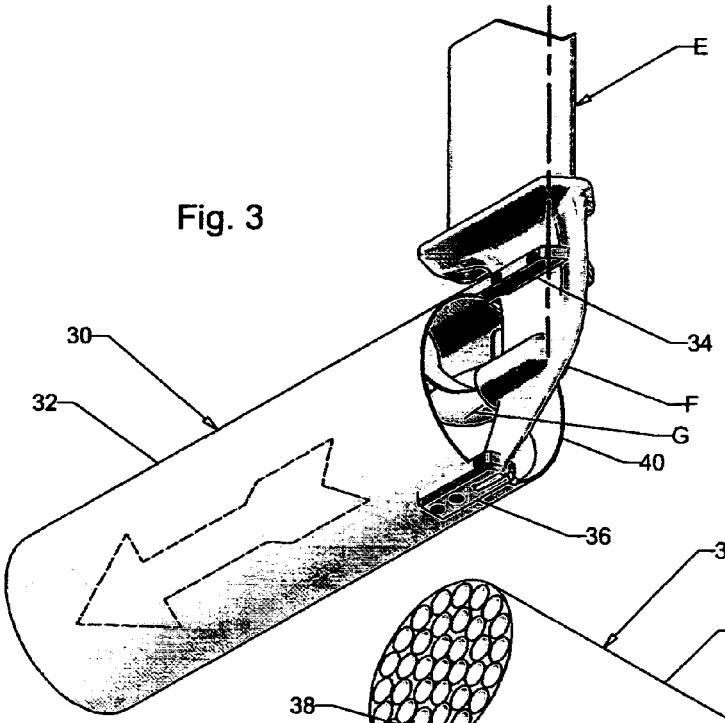
FIG. 3 is a forward perspective view of another embodiment of the invention attached to a steerable lower support unit for the propeller
Figure 4:
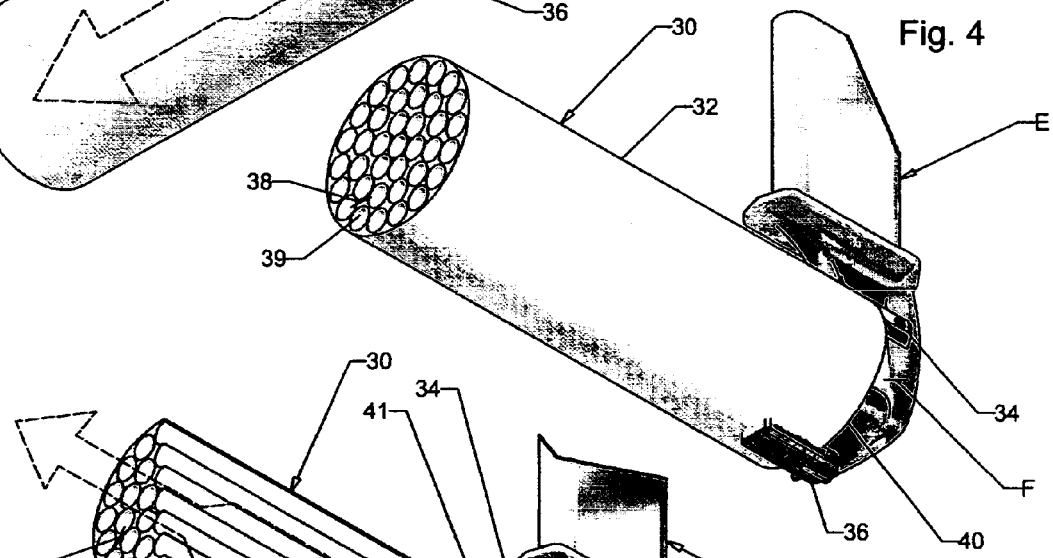
FIG. 4 is a rear perspective view of FIG. 3.
Figure 5:
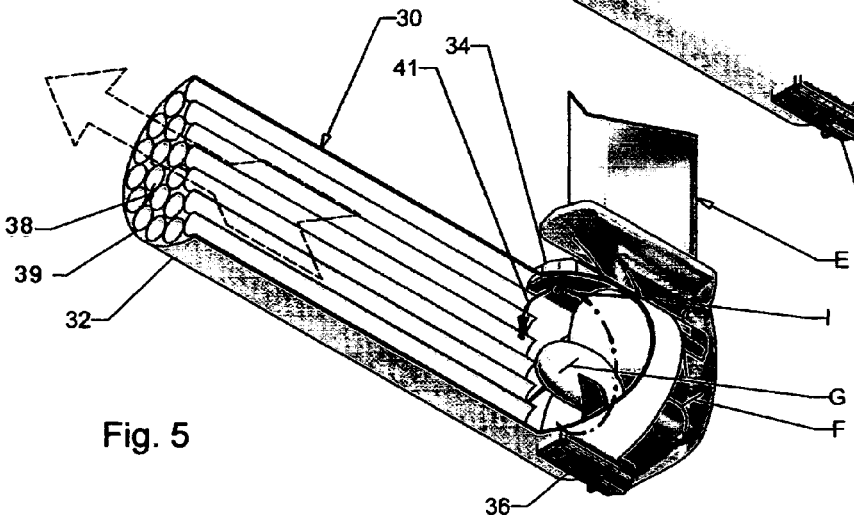
FIG. 5 is a partially broken view of FIG. 4.

Referring now to FIGS. 3 to 5, this embodiment 30 of the invention is adapted for attachment to the lower housing E of a steerable propulsion system having propeller G operably connected to the lower unit F for producing horizontal axial thrust in the direction of the arrow in hidden lines within the outer tubular member 32. The outer tubular member 32 is adapted for attachment by brackets 34 and 36 to the upper and lower portions of the lower unit F such that, as the lower housing E is rotated about an upright steering axis to steer the boat, the apparatus 30 is carried and rotated in the same fashion.

In this embodiment 30, the plurality of inner tubular members 39 is again generally coextensive with and closely nested together within the outer tubular member 32. However, the outer tubular member 32 extends forwardly of the leading or forwardly surface 41 of the plurality of tubular members 39 so as to surround the tips of the blades of the propeller G to help insure that virtually all of the prop wash discharges through the apparatus 30 in the direction of the hidden arrow in FIG. 3 absent any spiral twist component shown in phantom at I. Moreover, the plane 38 defining the rearwardly collective surfaces of the plurality of inner tubular members 39 is generally coplanar with the outer tubular member 32 as shown.

Figure 6:
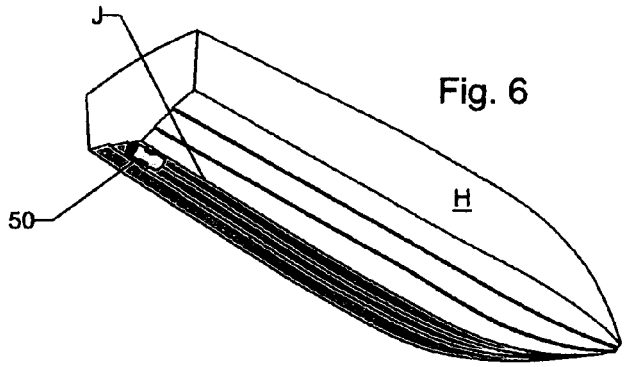
FIG. 6 is a rear perspective view of the hull of the watercraft incorporating a third embodiment of the invention.
Figure 7:
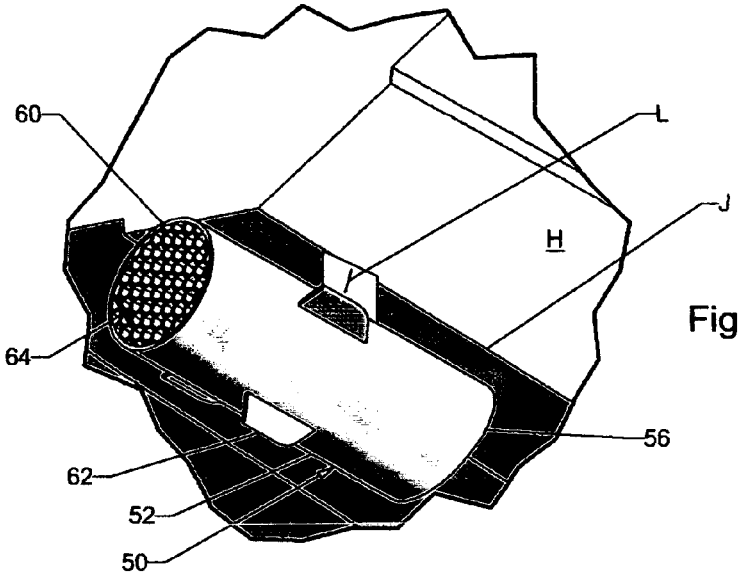
FIG. 7 is an enlarged view of a portion of FIG. 6.
Figure 8:
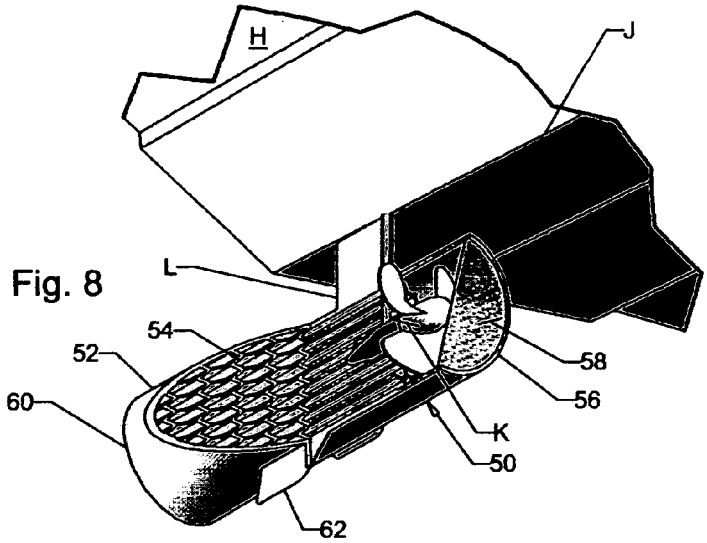
FIG. 8 is a partially broken view of FIG. 7 from the forwardly perspective view.

Referring now to FIGS. 6, 7 and 8, still another embodiment of the invention is there shown generally at numeral 50 attached in close proximity to a single propulsion means K in alignment with the longitudinal keel J of the watercraft H. A longitudinally extending mounting plate L which drivingly supports the propeller K is utilized to also support the apparatus 50 through its outer tubular member 52.

In this embodiment 50, the inner tubular members 54 have a hexagonal or honeycombed cross section, the purpose of which is to eliminate the potentially flow inhibiting cross sectional areas positioned between the closely nested circular tubular members of the inner tubular members previously described and to reduce the corrective frontal area of the inner tubular members 54. This honeycomb arrangement and each of its tubular members 54 completely define the open cross sectional area through which water must flow to propel the watercraft H. In this embodiment 50 the outer tubular member 52 also extends forwardly from the trailing edge of the propeller K and the forwardly planar surface of the inner tubular members 54.

A mesh or screen 58 is positioned at the forwardly end of the tubular member 52 to prevent debris from striking the propeller K. The planar rearward surface 64 of the array of tubular members 54 is coplanar with the rearward end 60 of the outer tubular member 52. Stabilizing and protective planes 62 are attached to and outwardly extending from the outer tubular member 52 for enhanced protection thereof from impact with ground or debris.

Figure 9:
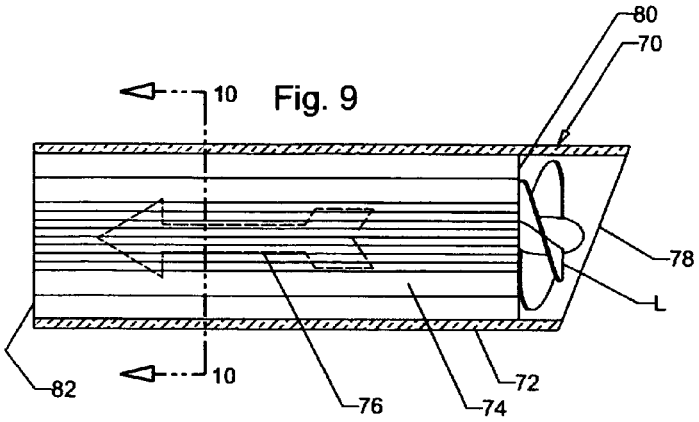
FIG. 9 is a side elevation section view of still another embodiment of the invention.
Figure 10:
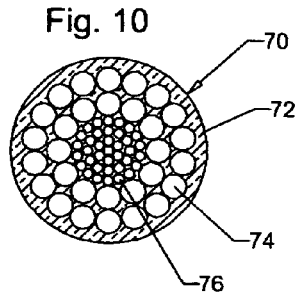
FIG. 10 is a section view in the direction of arrows 10—10 in FIG. 9.

Referring now to FIGS. 9 to 20, various further embodiments of the invention are there shown. In FIGS. 9 and 10, the inner or central portion 76 of the inner tubular members is of a substantially smaller diameter than the array of inner tubular members 74 which extend around the inner periphery of the outer tubular member 72. Again, in this embodiment 70, the outer tubular member 72 extends forwardly of the planar forward surface 80 of the inner tubular member arrays for insuring that virtually all of the water flow created by the rotation of the propeller L extends rearwardly through the apparatus 70 in the direction of the arrow shown in hidden lines.

Figure 11:
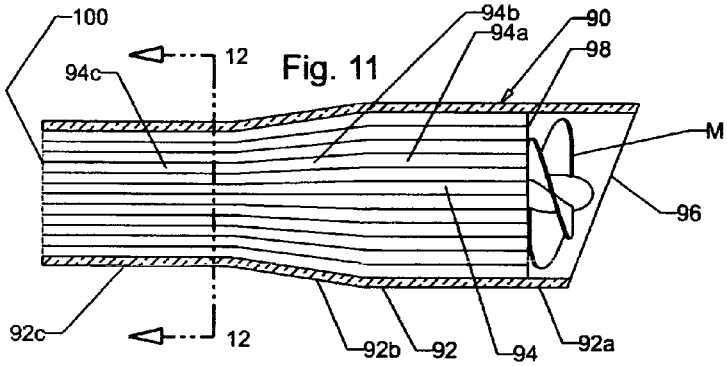
FIG. 11 is a side elevation section view of still another embodiment of the invention.
Figure 12:
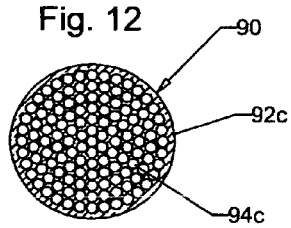
FIG. 12 is a section view in the direction of arrows 10—10 in FIG. 11.

The embodiment 90 shown in FIGS. 11 and 12 includes a dual diameter outer tubular member 92 having a larger diameter forwardly portion 92*a* sized to fit around the tips of the propeller M while the rearwardly portion transitions at 92*b* downwardly to a cylindrical smaller diameter 92*c*. The inner tubular members 94 likewise transition in diameter from a larger diameter at 94*a* through the transitional diameter 94*b* to the smallest diameter at 94*c* to help create a vortex affect for enhanced water flow therethrough.

Figure 13:
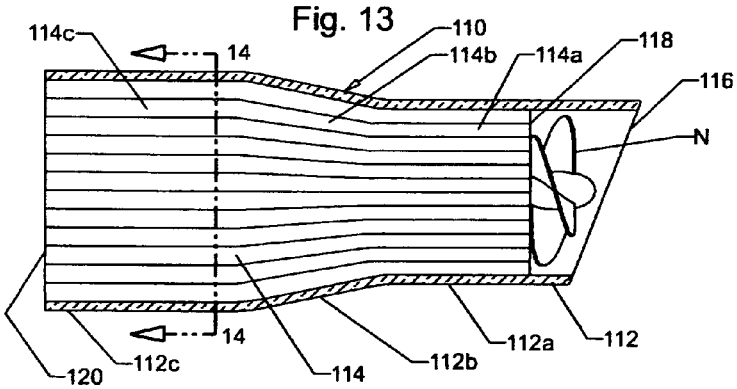
FIG. 13 is a side elevation section view of still another embodiment of the invention.
Figure 14:
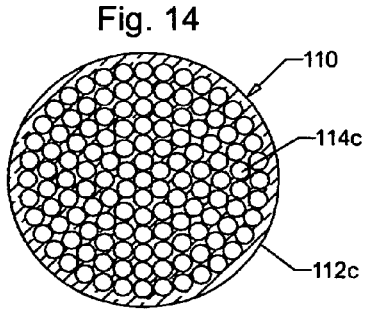
FIG. 14 is a section view in the direction of arrows 10—10 in FIG. 13.

The opposite effect is created with the embodiment 110 in FIGS. 13 and 14 wherein the outer tubular member 112 has a forwardly cylindrical portion 112*a* which is sized on its inner cylindrical surface to be just slightly larger than the diameter of propeller N. The central transitional portion 112*b* enlarges to the rearwardly portion 112*c* of the outer tubular member 112 to provide for reduced resistance to flow and to create a slight pressure gradient at surface 120, the rearwardly planar surface of the inner tubular members 114.

These inner tubular members 114 likewise transition at 114*b* forwardly portions 114*a* of the inner tubular members 114 which are of the smallest diameter while the central portion 114*b* expands to the largest rearward portion 114*c* of each of the tubular members 114. Termination at the rearwardly planar surface 120 is coplanar with the rearwardly end of the outer tubular member 112.

Figure 15:
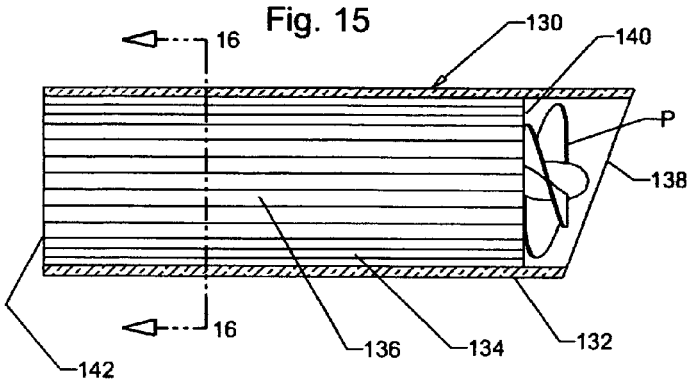
FIG. 15 is a side elevation section view of still another embodiment of the invention.
Figure 16:
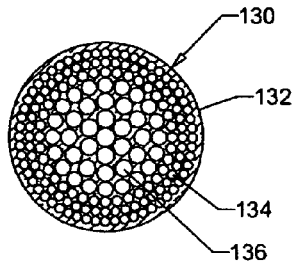
FIG. 16 is a section view in the direction of arrows 10—10 in FIG. 15.

The embodiment 130 of FIGS. 15 and 16 includes a cylindrical outer tubular member 132 sized to just fit around and forwardly extend around the outer diameter of propeller P. The diagonal leading edge 138 is provided for reduced water flow resistance of water entering into the open forwardly end of the tubular member 132. In this embodiment 130, the central array 136 of the inner tubular members is nested into a generally cylindrical central portion of tubular members 136 which are of a larger diameter while the tubular members 134 surrounding the larger inner tubular members 136 and fitting into and against the inner surface of the outer tubular member 132 are of a substantially smaller diameter.

Figure 17:
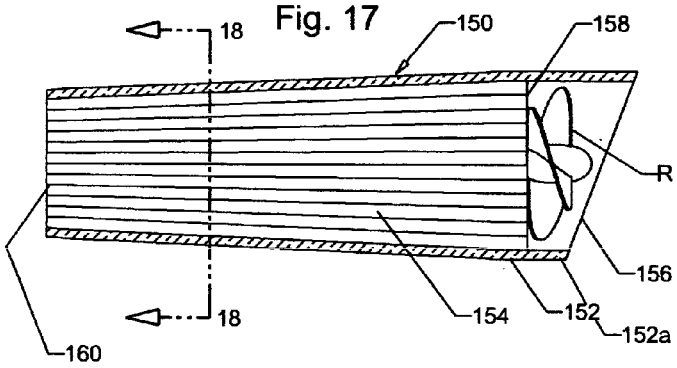
FIG. 17 is a side elevation section view of still another embodiment of the invention.
Figure 18:
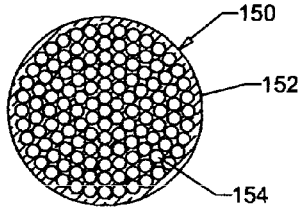
FIG. 18 is a section view in the direction of arrows 10—10 in FIG. 17.

In FIGS. 17 and 18, this embodiment 150 there shown includes a rearwardly tapering outer tubular member 152 which is sized at a forwardly leading edge 156 thereof to just fit around the tip of the blades of the propeller R. The inner tubular members 154 are uniformly sized and tapered so as to nest and be closely packed within the truncated conical inner surface of the inner tubular member 152 to create a nozzle effect. Again, the rearwardly plane 160 of the tubular members 154 is coplanar with the rearwardly end of the outer tubular member 152.

Figure 19:
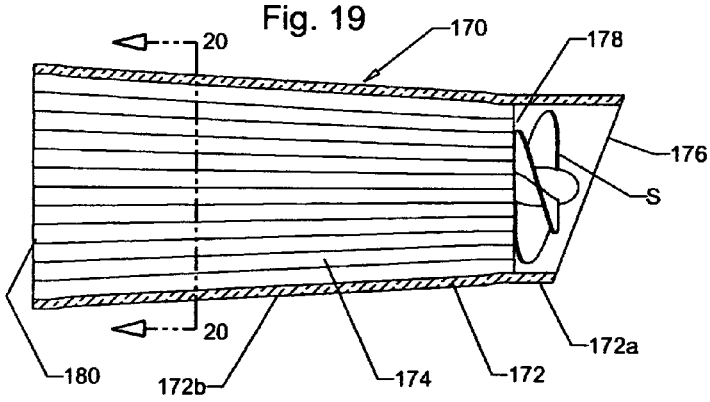
FIG. 19 is a side elevation section view of still another embodiment of the invention.
Figure 20:
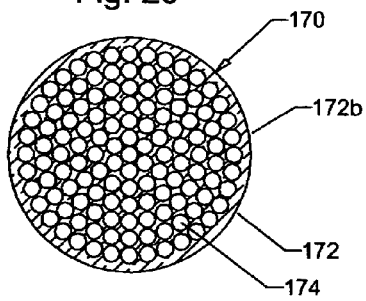
FIG. 20 is a section view in the direction of arrows 10—10 in FIG. 19.

In FIGS. 19 and 20, the embodiment 170 includes an outwardly tapering tubular member 172 which is sized at its forwardly cylindrical end 172*a* to just fit around and confine the tips of the propeller S so as to insure that all prop wash water flow flows into the leading surface 178 of the outwardly tapering plurality of tubular members 174. The rearwardly surface of the plurality of outwardly tapering inner tubular members 174 is coplanar with the rearwardly end of the outer tubular member 172.

Figure 21:
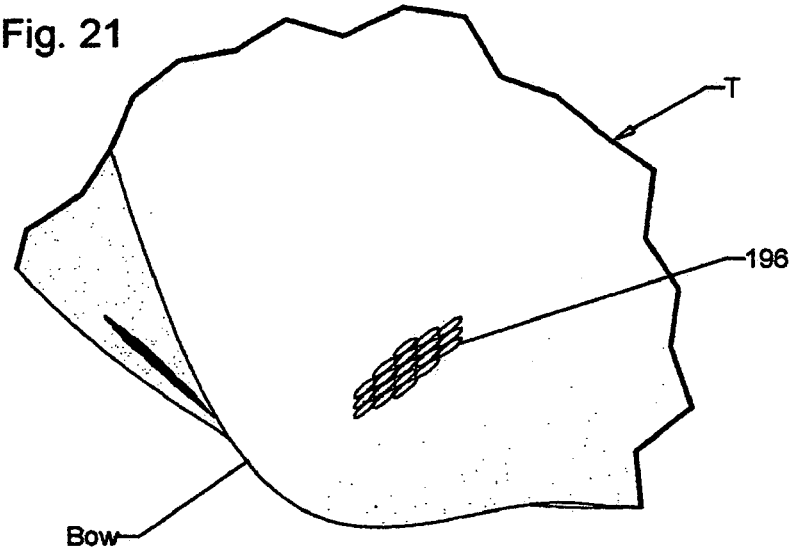
FIG. 21 is a perspective view of yet another embodiment of the invention.
Figure 22:
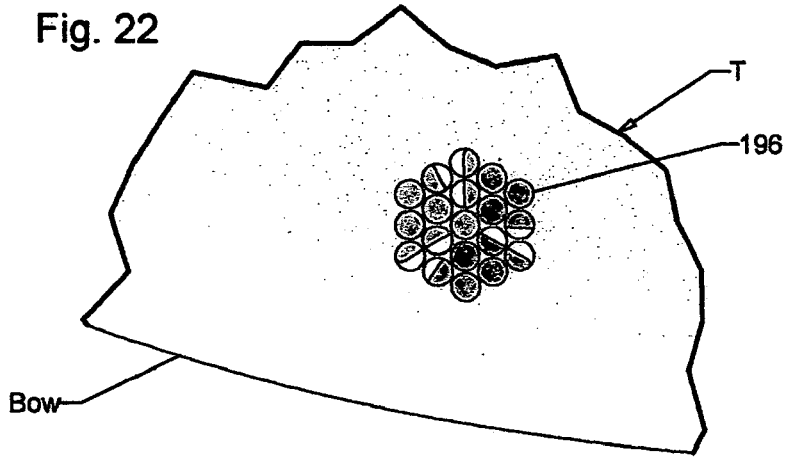
FIG. 22 is a side elevation view of FIG. 21.
Figure 23:
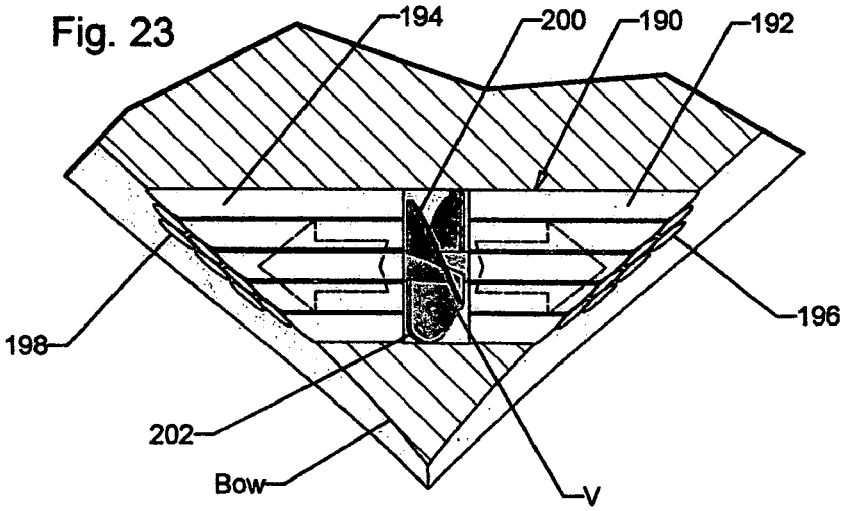
FIG. 23 is a vertical section view taken to the embodiment of the invention of FIG. 21.

Lastly, in FIGS. 21 to 23, yet another embodiment of the invention shown generally at numeral 190 is connected in transverse orientation through the lower bow area of the watercraft T. Again, a plurality of transversely oriented tightly nested inner tubular members 192 and 194 collectively define an outer tubular perimeter of this embodiment 190 transversely entirely through the bow. Side openings defined at 196 and 198 of the tubular members 192 and 194, respectively, transverse water flow through this embodiment 190 in either direction shown in hidden lines depending upon the direction of rotation of the propeller V. The planes of the propeller V lie in close proximity to the inner orthogonal surfaces 200 and 202 of the inner tubular members 192 and 194, respectively, to maximize the water flow straightening effect of this invention.

Note importantly that a wall thickness of the inner tubular members in all embodiments described is best selected to be as thin as possible and even sharpened at the leading or forwardly ends thereof to reduce resistance to water flow therethrough. Thus, minimizing the collective forwardly surface areas of the plurality of inner tubular members is of utmost importance. Tubular wall thicknesses of the inner tubular members which may be plastic or metal in the range of 0.03" to 0.06" in thickness is realistic when considering the collective strengthening and supporting effect of the closely nested inner tubular members within the outer tubular member inner surface thereof.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A prop wash straightening apparatus for a watercraft having a rotatable propeller for moving the watercraft, comprising:

an elongated substantially straight outer tubular member open at each end thereof and being connectable to the boat or vessel to position said outer member immediately downstream of the propeller and in substantially longitudinal fixed alignment with the direction of axial thrust produced by the propeller;

a plurality of elongated hollow substantially straight open-ended inner tubular members closely packed together and positioned in generally coaxial alignment within, and generally coextensive with a substantial portion of the length of said outer tubular member;

a proximal or forwardly end of said plurality positioned in close proximity to a trailing plane of the propeller;

a transverse size of each inner tube of said plurality of inner tubular members varies over a length thereof.

2. A prop wash straightening apparatus as set forth in claim 1, wherein:

said outer tubular member extends forwardly from the proximal or forwardly end of said plurality to substantially surround the blade tips of the propeller to direct substantially all water flow from the propeller into the proximal end of said plurality for discharge from a distal end of said plurality.

3. A prop wash straightening apparatus as set forth in claim 2, further comprising:

a protective screen or mesh attached across a leading edge of said outer tubular member, said leading edge positioned in proximity to and forwardly of a leading edge plane of the propeller.

4. A prop wash straightening apparatus as set forth in claim 1, wherein:

a support housing for the propeller is pivotable absent an upright axis to vary the direction of axial thrust to steer the boat or vessel;

said outer housing is adapted for connection to the support housing whereby said apparatus is pivoted with the support housing to maintain coaxial alignment with a thrust axis of the propeller.

5. A prop wash straightening apparatus as set forth in claim 1, wherein:

said plurality of inner tubular members are each circular in diameter and uniform in length.

6. A prop wash straightening apparatus as set forth in claim 1, wherein:

said plurality of inner tubular members are each of uniform size and polygonal in cross sectional configuration and uniform in length.

7. A prop wash straightening apparatus as set forth in claim 1, wherein:

said transverse size tapers uniformly inwardly from a leading surface of said plurality to a trailing surface thereof.

8. A prop wash straightening apparatus as set forth in claim 1 wherein:

said transverse size tapers uniformly outwardly from a leading surface of said plurality to a trailing surface thereof.

9. A prop wash straightening apparatus as set forth in claim 1, further comprising:

protective fins connected to and radially outwardly extending from said outer tubular member.

10. A prop wash straightening apparatus for a watercraft having a rotatable propeller for moving the watercraft, comprising:

an elongated substantially straight outer tubular member open at each end thereof and being connectable to the boat or vessel to position said outer member immediately downstream of the propeller and in substantially longitudinal fixed alignment with the direction of axial thrust produced by the propeller;

a plurality of elongated hollow substantially straight open-ended inner tubular members closely packed together and positioned in generally coaxial alignment within, and generally coextensive with a substantial portion of the length of said outer tubular member;

a proximal or forwardly end of said plurality positioned in close proximity to a trailing plane of the propeller;

said plurality of tubular members includes a first array of a first diameter tubular members and a second array of a second diameter tubular members arranged around a periphery portion of said plurality adjacent to said outer tubular member.

11. A prop wash straightening apparatus as set forth in claim 10, wherein:

said first diameter is larger than said second diameter.

12. A prop wash straightening apparatus as set forth in claim 10, wherein:

said first diameter is smaller than said second diameter.

13. A prop wash straightening apparatus as set forth in claim 10, wherein:

said outer tubular member extends forwardly from the proximal or forwardly end of said plurality to substantially surround the blade tips of the propeller to direct substantially all water flow from the propeller into the proximal end of said plurality for discharge from a distal end of said plurality.

14. A prop wash straightening apparatus as set forth in claim 10, wherein:

a protective screen or mesh attached across a leading edge of said outer tubular member, said leading edge positioned in proximity to and forwardly of a leading edge plane of the propeller.

15. A prop wash straightening apparatus as set forth in claim 10, wherein:

a support housing for the propeller is pivotable absent an upright axis to vary the direction of axial thrust to steer the boat or vessel;

said outer housing is adapted for connection to the support housing whereby said apparatus is pivoted with the support housing to maintain coaxial alignment with a thrust axis of the propeller.

16. A prop wash straightening apparatus as set forth in claim 10, wherein:

said plurality of inner tubular members are each circular in diameter and uniform in length.

17. A prop wash straightening apparatus as set forth in claim 10, wherein:

said plurality of inner tubular members are each of uniform size and polygonal in cross sectional configuration and uniform in length.

18. A prop wash straightening apparatus for a watercraft having a rotatable propeller for moving the watercraft, comprising:

an elongated substantially straight outer tubular member open at each end thereof and being connectable to the boat or vessel to position said outer member immediately downstream of the propeller and in substantially longitudinal fixed alignment with the direction of axial thrust produced by the propeller;

a plurality of elongated hollow substantially straight open-ended inner tubular members closely packed together and positioned in generally coaxial alignment within, and generally coextensive with a substantial portion of the length of said outer tubular member;

a proximal or forwardly end of said plurality positioned in close proximity to a trailing plane of the propeller said outer tubular member has a first tubular portion thereof being of larger uniform transverse size than that of a second tubular portion of said tubular member;

said first and second tubular portions being spaced apart and connected together by a tapered tubular transition member.

19. A prop wash straightening apparatus as set forth in claim 18, wherein:

said first tubular portion is forwardly on said tubular member, said second tubular portion being rearwardly on said tubular member.

20. A prop wash straightening apparatus as set forth in claim 18, wherein:

said first tubular portion is rearwardly on said tubular member, said second tubular portion being rearwardly on said tubular member.

21. A prop wash straightening apparatus as set forth in claim 18, wherein:

said outer tubular member extends forwardly from the proximal or forwardly end of said plurality to substantially surround the blade tips of the propeller to direct substantially all water flow from the propeller into the proximal end of said plurality for discharge from a distal end of said plurality.

22. A prop wash straightening apparatus as set forth in claim 18, further comprising:

a protective screen or mesh attached across a leading edge of said outer tubular member, said leading edge positioned in proximity to and forwardly of a leading edge plane of the propeller.

23. A prop wash straightening apparatus as set forth in claim 18, wherein:

a support housing for the propeller is pivotable absent an upright axis to vary the direction of axial thrust to steer the boat or vessel;

said outer housing is adapted for connection to the support housing whereby said apparatus is pivoted with the support housing to maintain coaxial alignment with a thrust axis of the propeller.

24. A prop wash straightening apparatus as set forth in claim 18, wherein:

said plurality of inner tubular members are each circular in diameter and uniform in length.

25. A prop wash straightening apparatus as set forth in claim 18, wherein:

said plurality of inner tubular members are each of uniform size and polygonal in cross sectional configuration and uniform in length.

* * * * *